US006878002B2

(12) United States Patent
Osawa et al.

(10) Patent No.: US 6,878,002 B2
(45) Date of Patent: Apr. 12, 2005

(54) CONNECTOR

(75) Inventors: Hiroki Osawa, Yokkaichi (JP); Tomohisa Mizoguchi, Yokohama (JP)

(73) Assignees: Sumitomo Wiring Systems, Ltd. (JP); Nissan Motor Co., Ltd. (JP)

( * ) Notice: Subject to any disclaimer, the term of this patent is extended or adjusted under 35 U.S.C. 154(b) by 0 days.

(21) Appl. No.: 10/829,735

(22) Filed: Apr. 22, 2004

(65) Prior Publication Data

US 2004/0214460 A1 Oct. 28, 2004

(51) Int. Cl.[7] ..... H01R 13/62
(52) U.S. Cl. ..... 439/157
(58) Field of Search ..... 439/152, 153, 439/595, 437, 355, 347, 159, 154–160, 372, 345–346, 91, 591

(56) References Cited

U.S. PATENT DOCUMENTS 3,575,685 A * 4/1971 Gley ..... 439/157
5,263,871 A * 11/1993 Sano ..... 439/157
5,320,544 A * 6/1994 Naoto et al. ..... 439/157
5,899,762 A * 5/1999 Ainceri ..... 439/157
6,102,718 A * 8/2000 Kumakura et al. ..... 439/157
6,155,850 A * 12/2000 Martin et al. ..... 439/157
2003/0224639 A1 * 12/2003 Yano et al. ..... 439/157

FOREIGN PATENT DOCUMENTS

JP 1-130282 9/1989

* cited by examiner

*Primary Examiner*—J. F. Duverne
(74) *Attorney, Agent, or Firm*—Gerald E. Hespos; Anthony J. Casella

(57) ABSTRACT

In a waiting-side connector 40, a cover 42 is detachably mounted on the rear surface of a female housing 41. Leg pieces 44 projecting from the female housing 41 are formed with guide rails 45 to define an insertion path 46 for a bracket 10. A lock protrusion 54 is formed on the rear surface of the cover 42, whereas a lock hole 11 is formed in the bracket 10. Independent follower pins 60, 61 are provided on the female housing 41 and the cover 42. In an area of a cam groove 32 of each lever 30 of a movable-side connector 20 corresponding to a final stage of a separating operation, cam surfaces 65, 66 for individually pushing the follower pins 60, 61 are formed such that the cover 42 is less separated than the female housing 41.

3 Claims, 8 Drawing Sheets

CONNECTOR

BACKGROUND OF THE INVENTION

1. Field of the Invention

The present invention relates to a bracket-mounted connector.

2. Description of the Related Art

In the case of assembling a module such as an instrument panel with a body in an automotive vehicle, a movable-side connector provided on the module is connected with a waiting-side connector mounted on the body as the module is assembled in order to reduce the number of operation steps for the assembling.

The waiting-side connector is mounted on the body via a bracket. Specifically, the plate-shaped bracket projects from the body, whereas a rail-shaped insertion path is formed on an outer surface of the connector housing. When the bracket is inserted into the insertion path up to a specified position, a lock projection provided on the insertion path is fitted into and engaged with a lock hole formed in the bracket to mount the waiting-side connector so as not to come off.

This type of the bracket-mounted connector is disclosed in JP-UM-A-1-130282.

SUMMARY OF THE INVENTION

The waiting-side connector needs to be detached from the body for maintenance or other reason. Conventionally, the waiting-side connector has been pulled after the lock projection is pushed to be disengaged from the lock hole while resiliently deforming the bracket and the insertion path (rail). However, depending on the disposed position of the bracket, the detaching operation is very difficult to carry out because an operator has to feel for it without being able to see and/or has only a narrow space for hands. Thus, there has been a demand for improvements.

The present invention was developed in view of the above problem and an object thereof is to efficiently detach a connector from a bracket.

In order to achieve the object, according to one aspect of the invention, there is provided a connector including a first connector and a second connector, wherein the first connector includes: a first connector housing; a cover that forms a wire draw-out passage and mountable on a backside of the first connector housing so as to be movable in directions toward and away from the first connector housing; an insertion path into which a bracket is inserted and protruded to a position where more backward than the cover; a locking member provided on a facing surface of the cover and the bracket and engages to an locked portion formed on the bracket; a first follower pin provided on the first connector housing; and a second follower pin provided on the cover, wherein the second connector includes; a second connector housing that is to be connected with the first connector housing; and a lever that is rotatably attached to the second connector housing and formed with a cam groove that is engageable with both the first and the second follower pins, wherein the cover is mounted on the first connector housing at a position distanced from a rear surface of the first connector housing when the first and the second connectors are in a non-connected state, wherein the first connector housing is connected with or separated from the second connector housing together with the cover by a cam action between the cam groove and both of the first and the second follower pins caused by a rotation of the lever, wherein an amount of a separation of the cover is configured to be less than an amount of a separation of the first connector housing with respect to the second connector housing at a final stage of a separating operation.

BRIEF DESCRIPTION OF THE DRAWINGS

The objects and advantages of the present invention will become more apparent by describing a preferred embodiment thereof in detail with reference to the accompanying drawings, wherein.

DETAILED DESCRIPTION OF THE PREFERRED EMBODIMENTS

Referring now to the accompanying drawings, a description will be given in detail of preferred embodiments of the invention.

Figure 1:
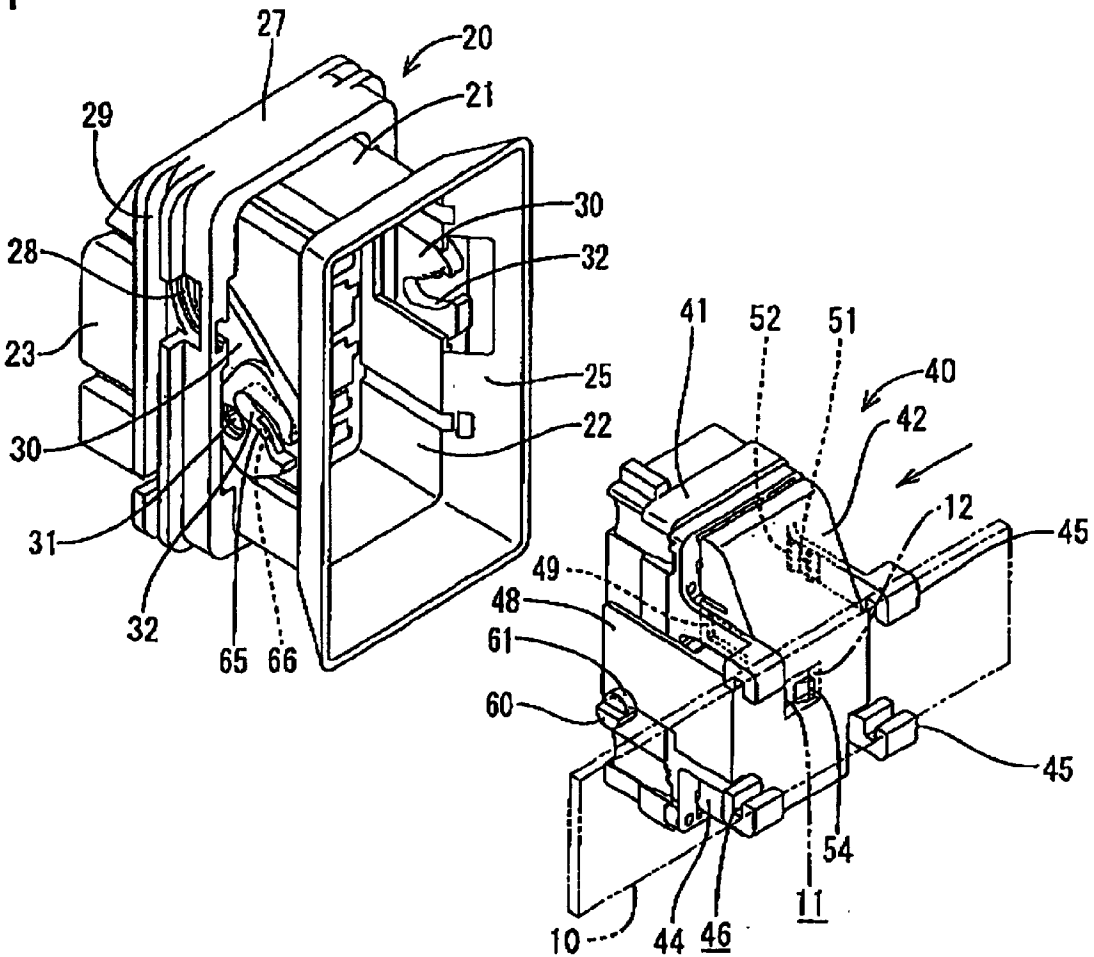
FIG. 1 is a perspective view showing a state before a waiting-side connector and a movable-side connector according to one embodiment of the invention are connected.
Figure 2:
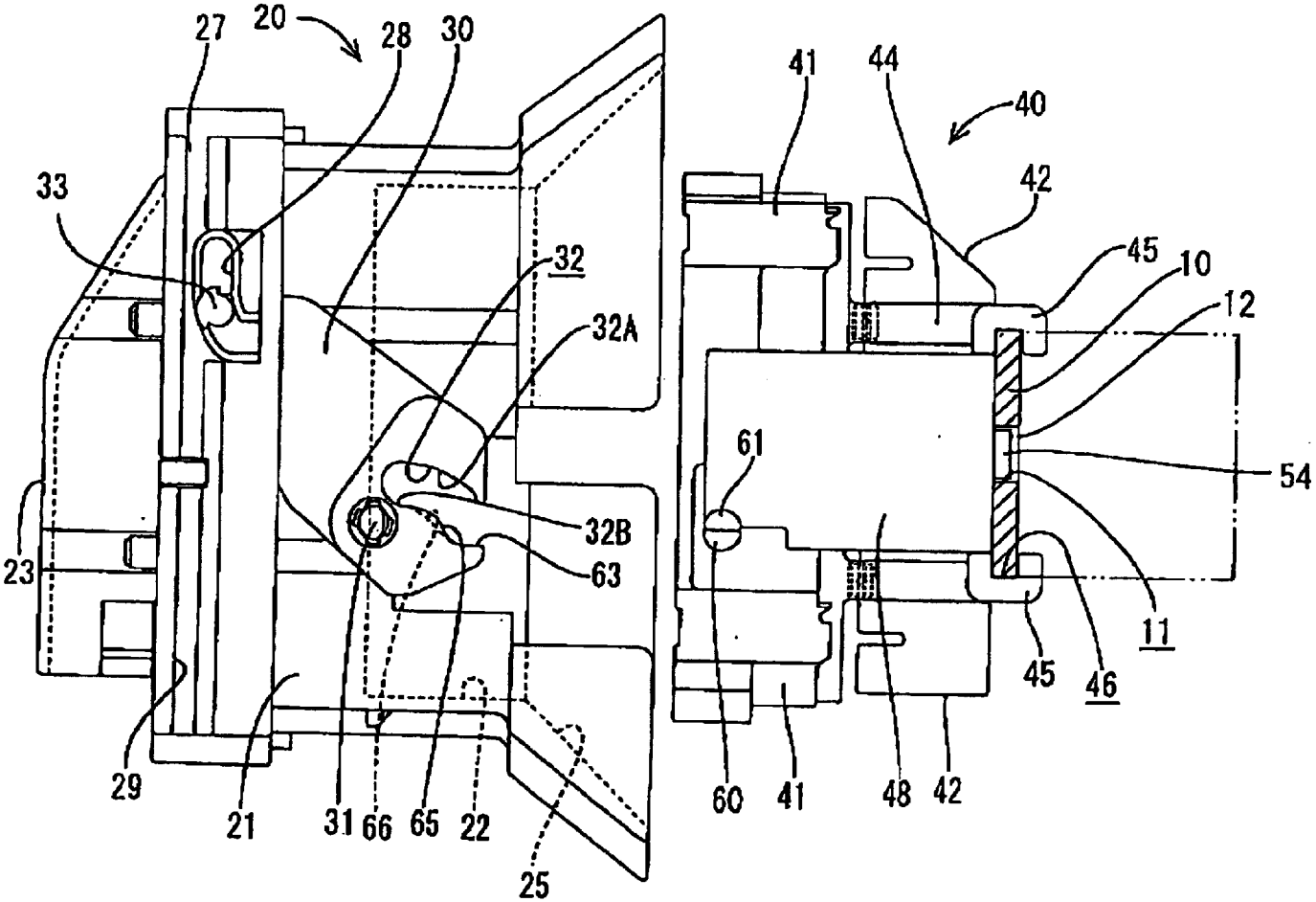
FIG. 2 is a side view partly in section showing the two connectors.

Hereinafter, an embodiment is described in which the present invention is applied to a waiting-type connector. As shown in FIGS. 1 and 2, a movable-side connector 20 is mounted on a module of an automotive vehicle such as an instrument panel, whereas a waiting-side connector 40 is mounted on a body via a bracket. As the module is assembled with the body, the movable-side connector 20 is connected with the waiting-side connector 40.

In the following description, sides of the two connectors 20, 40 to be connected are referred to as front side.

The movable-side connector 20 is a male connector and constructed such that male terminals (not shown) are inserted from behind to be accommodated into a male housing 21 formed with a rectangular and forward-opening receptacle 22, and a wire cover 23 is mounted on the rear surface of the male housing 21 to guide and draw out a group of wires pulled out through the rear surface together in a specified direction (downward direction). A guiding portion 25 gradually widened toward the front is formed at the opening edge of the receptacle 22, so that a displacement of a female housing 41 of the waiting-side connector 40 to be described later can be corrected by bringing the outer peripheral portion of the front surface of the female housing 41 into contact with the guiding portion 25 upon fitting the female housing 41 into the receptacle 22.

Figure 5:
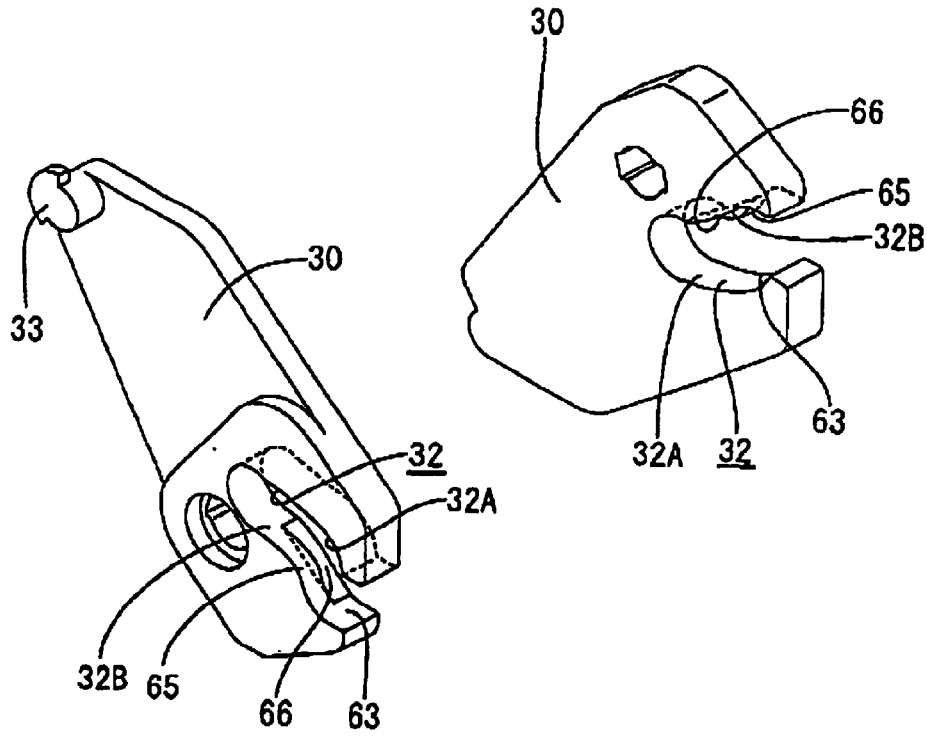
FIG. 5 is a perspective view of levers.

A rectangular frame 27 is so mounted on the outer circumferential surface of the male housing 21 as to be movable along forward and backward directions, and a pair of levers 30 are rotatably supported on the left and right side surfaces of the male housing 21 about shafts 31. As shown in FIG. 5, both levers 30 are in transversely symmetrical postures, cam grooves 32 engageable with follower pins 60, 61 of the waiting-side connector 40 are formed at the front ends of the levers 30 as described in detail later, and auxiliary follower pins 33 stand at the rear ends of the levers 30 and are engaged with auxiliary cam grooves 28 formed in the frame 27.

Here, since a distance between the shafts 31 for the levers 31 and the auxiliary follower pins 33 at the rear ends is set to be longer than a maximum distance from the shafts 31 to the cam grooves 32, large moments centered on the shafts 31 are created on the levers 30 by the engagement of the auxiliary follower pins 33 at the rear ends of the levers 30 and the auxiliary cam grooves 28 of the frame 27 when the male housing 21 is moved relative to the frame 27 along forward and backward directions. By these moments, a large pushing/pulling force acting along a connecting direction is given to the follower pins 60, 61 of the waiting-side connector 40 engaged with the cam grooves 32 of the levers 30.

The frame 27 is mounted in a mount opening of the module although not shown in detail, and the frame 27 and the male housing 21 are movably supported along the vertical direction of FIG. 1 in the mount opening of the module by engaging the left and right side edges of the mount opening with guide grooves 29 formed in the left and right side surfaces of the frame 27.

It should be noted that the male housing 21, the wire cover 23, the frame 27 and the levers 30 are all made of a synthetic resin.

Figure 3:
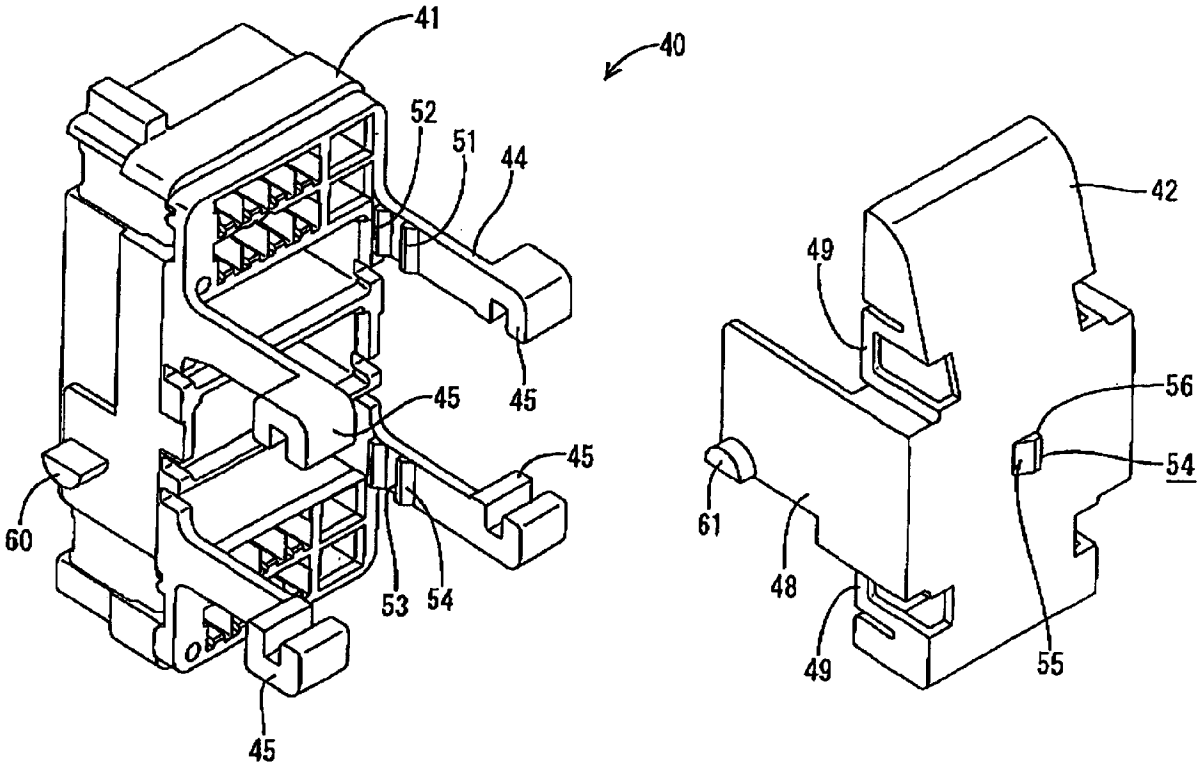
FIG. 3 is an exploded perspective view of the waiting-side connector.
Figure 4:
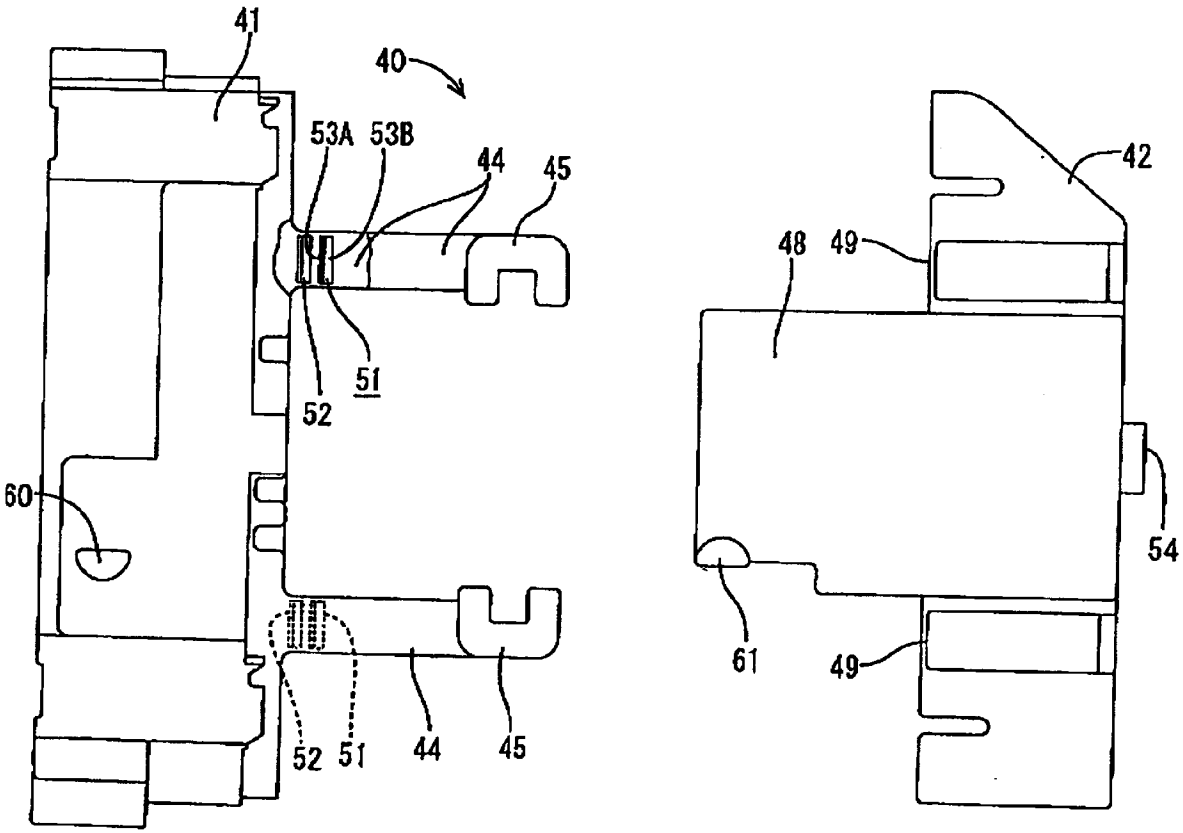
FIG. 4 is an exploded side view partly in section showing the waiting-side connector.

The waiting-side connector 40 is a female connector and is comprised of the female housing 41 made of a synthetic resin and in the form of a block fittable into the receptacle 22 of the aforementioned male housing 21 and a wire cover 42 likewise made of a synthetic resin and mountable on the rear surface of this female housing 41 as shown in FIGS. 3 and 4.

Female terminals (not shown) are inserted into the female housing 41 from behind to be accommodated therein, whereas the wire cover 42 functions to guide and drawn out a group of wires pulled out through the rear surface of the female housing 41 together in a specified direction (downward direction).

The waiting-side connector 40 is mountable on the body via a bracket 10 beforehand. The bracket 10 is made of a synthetic resin plate or a metallic plate and has, for example, a narrow cranked shape, wherein a base end side thereof is fixed to the body and a leading end side thereof transversely extends while being raised from the outer surface of the body by a specified distance as shown in chain line in FIG. 1.

Two upper and lower leg pieces 44 project from each of the left and right side edges of the rear surface of the female housing 41, i.e. a total of four leg pieces 44 project, and short and transversely extending guide rails 45 are so formed at the projecting ends of the respective leg pieces 44 as to vertically face each other. The bracket 10 is insertable between the upper and lower guide rails 45, i.e. the guide rails 45 defines an insertion path 46 for the bracket 10.

A pair of holding plates 48 for tightly holding the left and right side surfaces of the female housing 41 project forward from the left and right side surfaces of the wire covers 42, and frame-shaped resilient locking pieces 49 are formed at the upper and lower sides of the base end of each holding plate 48. Accordingly, the wire cover 42 is mountable on the rear surface of the female housing 41 while sliding the respective resilient locking pieces 49 along the inner surfaces of the leg pieces 44 and tightly holding the left and right side surfaces of the female housing 41 by the two holding plates 48.

Two locking projections 51, 52 engageable with the corresponding resilient locking piece 49 are formed at the base side of a surface of each leg piece 44 facing the transversely adjacent leg piece 44. When viewed from behind, the locking projections at the front side are first locking projections 51 and those at the back side are second locking projections 52. The front surfaces of the locking projections 51, 52 are steep locking surfaces 53A and the rear surfaces thereof are slanted guide surfaces 53B.

Figure 6:
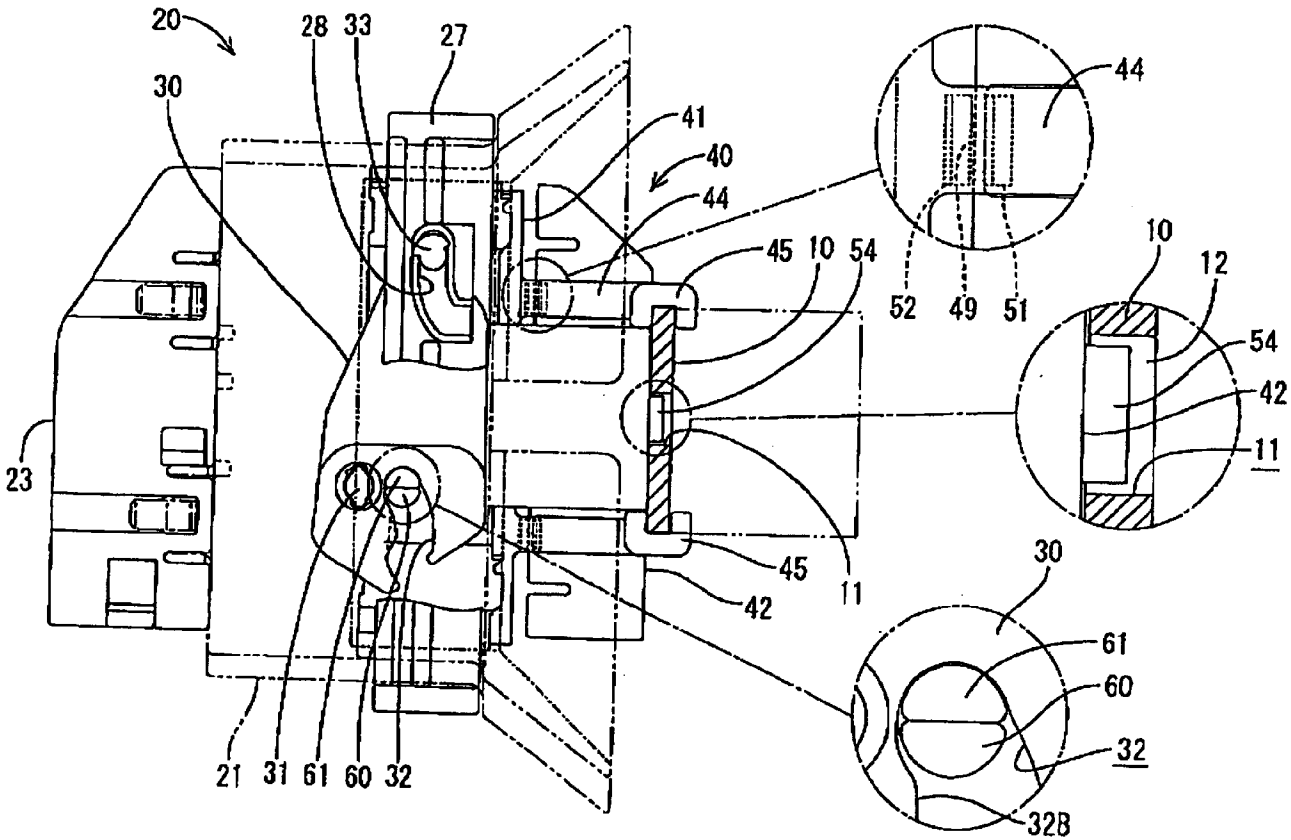
FIG. 6 is a side view partly in section showing a connected state of the two connectors.
Figure 8:
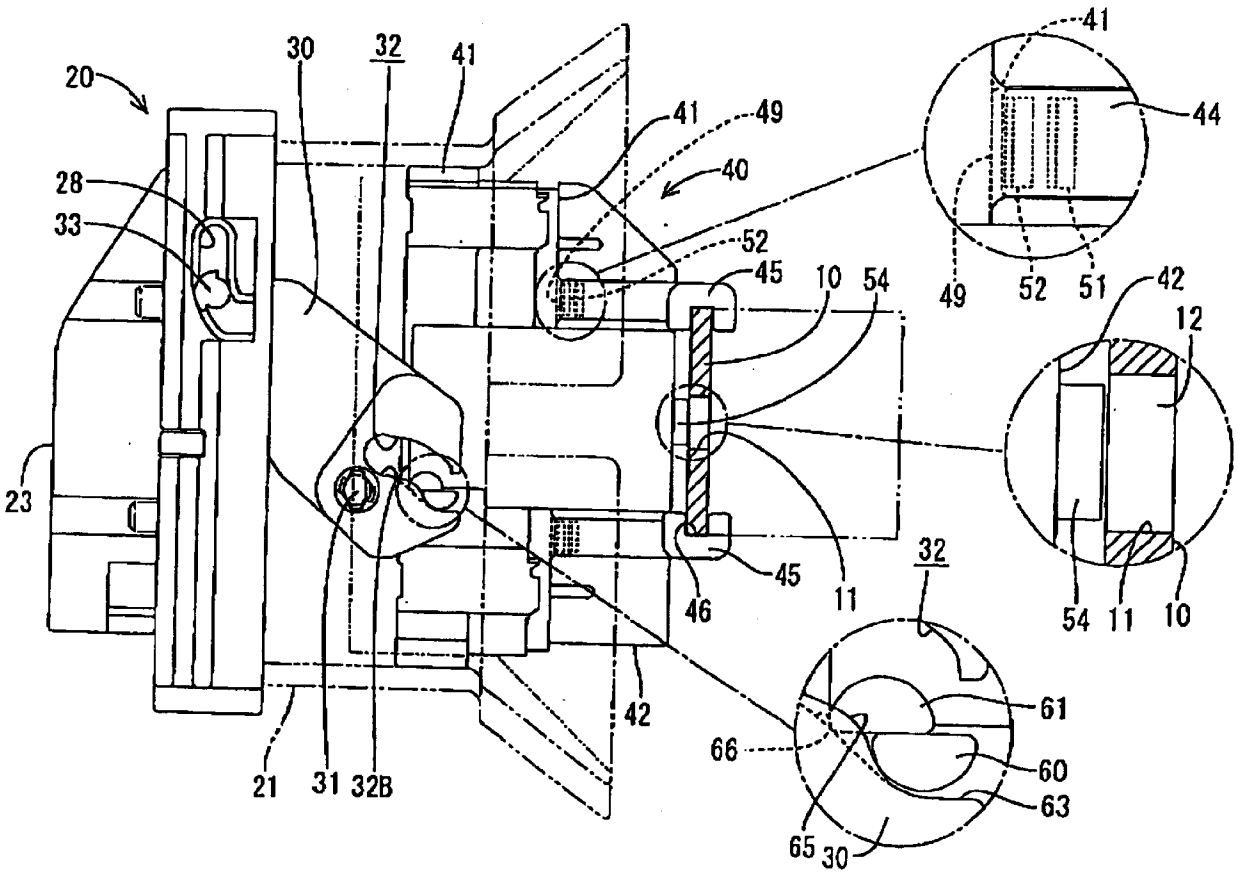
FIG. 8 is a side view partly in section showing a state immediately before the separation of the two connectors is completed.

When the wire cover 42 is mounted on the rear surface of the female housing 41 as described above, the resilient locking pieces 49 are first fitted between the corresponding first and second locking projections 51, 52 to hold the wire cover 42 at a specified distance from the rear surface of the female housing 41 as shown in FIG. 6. This position is a distanced position of the wire cover 42. When the wire cover 42 is further pushed to come into contact with the rear surface of the female housing 41, the resilient locking pieces 49 move over the second locking projections 52 to engage the front ends thereof as shown in FIG. 8, i.e. the wire cover 42 is held in contact with the rear surface of the female housing 41. This position is a proximate position of the wire cover 42.

When the wire cover 42 is at the distanced position, the rear surface of the wire cover 42 is aligned with the insertion path 46 for the bracket 10, i.e. the rear surface of the wire cover 42 forms the bottom surface of the insertion path 46.

A lock protrusion (locking member) 54 is formed on the rear surface of the wire cover 42, whereas a lock hole (locked portion) 11 engageable with the lock protrusion 54 is formed in the bracket 10.

The lock protrusion 54 is rectangular in plan view, and a slanted guiding surface 55 is formed at the left side and a steep locking surface 56 is formed at the right side when viewed from behind. The lock hole 11 is also rectangular and the right edge thereof when viewed from behind serves as a locking edge 12 engageable with the locking surface 56.

It should be noted that a transverse dimension of the lock hole 11 is set to be larger than a corresponding dimension of the lock protrusion 54 to define a clearance. Accordingly, the wire cover 42, i.e. the female housing 41 is transversely movable by as much as the clearance even after the lock protrusion 54 is fitted and locked in the lock hole 11.

The height of the lock protrusion 54 is set to be slightly shorter than a moving distance of the wire cover 42 between the distanced position and the proximate position. Thus, when the wire cover 42 is moved to the proximate position, the lock protrusion 54 comes out forward from the lock hole 11 (see FIG. 8).

The two connectors 20, 40 are connected and separated by operating the levers 30.

Thus, the housing-side follower pins 60 project from the left and right side surfaces of the female housing 41. These housing-side follower pins 60 are formed to have a cross section of a lower half of a circle. On the other hand, cover-side follower pins 61 project at the bottom end of the projecting ends of the holding plates 48 of the wire covers 42. These cover-side follower pins 61 are formed to have a cross section of an upper half of a circle.

With the wire cover 42 mounted at the aforementioned distanced position, the corresponding follower pins 60, 61 are united one over the other to form a circular cross section as shown in FIG. 2, and are aligned with the corresponding cam grooves 32 of the levers 30 provided on the movable-side connector 20 to be fitted thereinto.

The housing-side follower pins 60 are formed to have a larger height than the cover-side follower pins 61. The housing-side follower pins 60 are engaged with the cam grooves 32 over the entire depths of the cam grooves 32, whereas the cover-side follower pins 61 are engaged with the cam grooves 32 in a substantially half area at a deeper (inner side) side.

The cam groove 32 formed in each cover 30 is so curved that a distance to the shaft 31 gradually decreases as the cam groove 32 extends from an entrance 63 toward the back side. An upper surface 32A in FIG. 2 functions as a cam surface used for the connection of the two connectors 20, 40, and a lower surface 32B thereof functions as a cam surface used for the separation of the two connectors 20, 40.

Here, on the side surface 32B governing the separating operation, an area near the entrance 63 corresponds a final stage of the separating operation. As also shown in FIG. 5, this area is divided into two cam surfaces 65, 66 along depth direction. More specifically, the cam surface at a less deeper side (outer side) is the housing-side cam surface 65, and the one at a deeper side (inner side) is the cover-side cam surface 66. The cover-side cam surface 66 is so curved as to be less distanced from the shaft 31 as it extends toward the entrance 63 as compared to the housing-side cam surface 65.

Hereinafter, a mechanism of the embodiment are described.

In the waiting-side connector 40, the wire cover 42 is mounted at the distanced position with respect to the rear surface of the female housing 41 as shown in FIGS. 1 and 2. At this time, the rear surface of the wire cover 42 is aligned with the insertion path 46 for the bracket 10, and the housing-side follower pins 60 and the cover-side follower pins 61 are integrally united to have a circular cross section together.

In this state, the insertion path 46 of the waiting-side connector 40 is moved as indicated by an arrow in FIG. 1 to insert the bracket 10 thereinto. The bracket 10 is inserted into the insertion path 46 while moving along the guiding surface 55 of the lock protrusion 54. When the bracket 10 is inserted by a specified distance, the lock hole 11 reaches the position of the lock protrusion 54 to fit the lock protrusion 54 thereinto, thereby engaging the locking surface 56 with the locking edge 12. Thus, the waiting-side connector 40 is so mounted on the bracket 10 as not to come off.

The movable-side connector 20 is mounted on the module not shown. As the module is assembled with the body, the movable-side connector 20 is connected with the waiting-side connector 40 opposed to the movable-side connector 20. At this time, even if the movable-side connector 20 is displaced in a direction (upward, downward, leftward or rightward direction) intersecting with the connecting direction with respect to the waiting-side connector 40, the slanted inner surface of the guiding portion 25 comes into contact with the outer peripheral edge of the front surface of the female housing 41 and such a displacement is corrected by a vertical movement of the movable-side connector 20 or a transverse movement of the waiting-side connector 40 along the inclination of the guiding portion 25 as the connecting operation proceeds.

When the female housing 41 is fitted into the receptacle 22 of the male housing 21, the united follower pins 60, 61 enter the entrances 63 of the cam grooves 32 of the corresponding levers 30. Thereafter, if the frame 27 is relatively moved forward with respect to the movable-side connector 20 by a connection resistance created between the two connectors 20, 40, the levers 30 shown in FIG. 2 are rotated in clockwise direction in FIG. 2 by the engagement of the auxiliary cam grooves 28 of the frame 27 and the auxiliary follower pins 33, and the movable-side connector 20 is pulled into the waiting-side connector 40 by the engagement of the side surfaces 32B of the cam grooves 32 and the follower pins 60, 61. When the follower pins 60, 61 reach the back ends of the cam grooves 32 as shown in FIG. 6, the two connectors 20, 40 are properly connected.

Upon the need to detach the waiting-side connector 40 for maintenance or other reason, it is done as follows. When the module is detached from the body, the frame 27 is relatively moved backward with respect to the movable-side connector 20 and the levers 30 are accordingly rotated in a direction opposite from the rotating direction thereof at the time of the connecting operation, whereby the follower pins 60, 61 are pushed by the side surfaces 32B of the cam grooves 32 to gradually separate the two connectors 20, 40.

Figure 7:
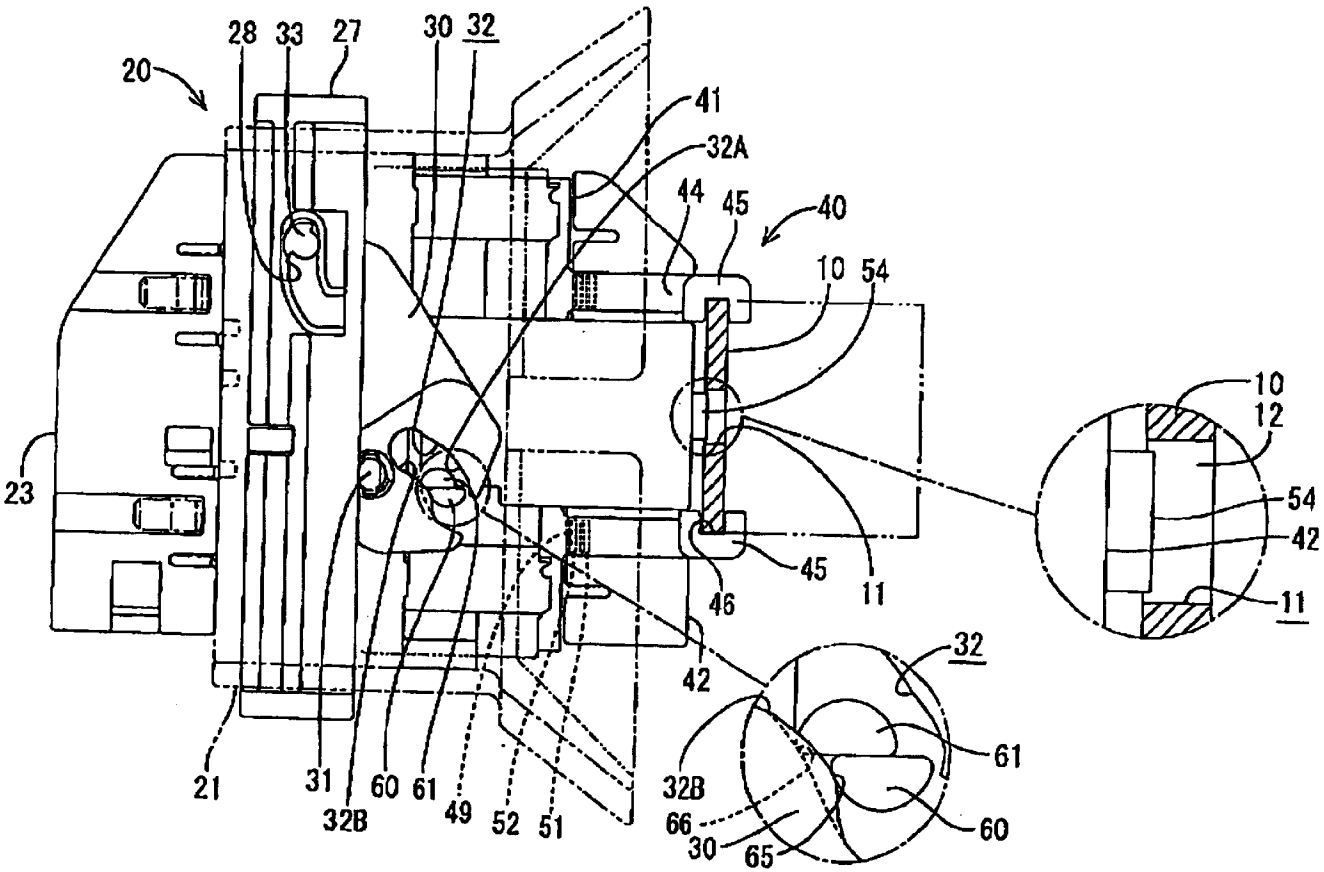
FIG. 7 is a side view partly in section showing a state at a final stage of the separation of the two connectors.

When the final stage of the separating operation approaches, the housing-side cam surfaces 65 and the cover-side cam surfaces 66 are individually pressed against the housing-side follower pins 60 and the cover-side follower pins 61 as shown in FIG. 7. Since the cover-side cam surfaces 66 are so curved as to be less distanced from the shafts 31 as they extend toward the entrances 63 as compared to the housing-side cam surfaces 65, the cover-side follower pins 61 are pushed less than the housing-side follower pins 60, whereby the follower pins 60, 61 are displaced from each other along forward and backward directions. In other words, the wire cover 42 of the waiting-side connector 40 is less separated from the movable-side connector 20 than the female housing 41 of the waiting-side connector 40, with the result that the wire cover 42 is gradually moved toward the proximate position while the resilient locking pieces 49 move over the first locking projections 51.

While the levers 30 are returned to their initial positions, the wire cover 42 is moved to the proximate position and held at this position by the engagement of the resilient locking pieces 49 with the second locking projections 52 as shown in FIG. 8. Accordingly, the lock protrusion 54 provided on the wire cover 42 comes out forward from the lock hole 11 of the bracket 10, i.e. the locked state is canceled.

When the module is detached, the movable-side connector 20 is separated from the waiting-side connector 40 while the follower pins 60, 61 exit from the entrances 63 of the cam grooves 32, and the waiting-side connector 40 comes to be open forward. Since the locked state of the waiting-side connector 40 and the bracket 10 is already canceled as described above, the waiting-side connector 40 can be detached from the bracket 10 if being gripped and slid along the bracket 10 in an direction opposite from the inserting direction.

As described above, according to the embodiment, the locked state of the waiting-side connector 40 and the bracket 10 is canceled upon separating the two connectors 20, 40 by operating the levers 30 when the module is detached. Thus, the waiting-side connector 40 can be easily detached only by being successively slid in the direction opposite from the inserting direction with respect to the bracket 10. Further, since the locked state is also canceled taking advantage of the cam action by the levers 30, it can be done with a small operation force.

More specifically, the female housing 41 and the wire cover 42 are provided with the independent follower pins 60, 61, and the cam surfaces 65, 66 having different curved shapes are individually engaged with the follower pins 60, 61 at the final stage of the separating operation by the levers 30 to move the wire cover 42 provided with the lock protrusion 54 toward the female housing 41, thereby canceling the locked state. Since the follower pins 60, 61 can be united and the cam grooves 32 is a single groove common to the follower pins 60, 61 with only a necessary part thereof divided into the differently shaped cam surfaces 65, 66, the construction of the connector can be simpler, which leads to the miniaturization of the connector.

The present invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

(1) In order to conform to the follower pins independently provided on the female housing and the wire cover, each lever may be individually formed with cam grooves engageable with the respective follower pins.

(2) Converse to the foregoing embodiment, the lock protrusion may be provided on the bracket and the lock hole may be formed in the wire cover.

(3) The present invention is not limited to application in a case where the connectors are connected as the module is assembled with the body, and is also applicable to, for example, a case where a mating connector is directly connected with a waiting-side connector mounted on a bracket by operating a lever.

As described above, according to the embodiment, when the lever is rotated to separate the one connector housing from the other connector housing together with the cover, the cover is moved to the position proximate to the rear surface of the one connector housing, i.e. the cover is separated from the bracket to widen a spacing therebetween since the cover is less separated than the one connector housing. Thus, the locking member are disengaged from each other. Therefore, after the other connector housing is detached, the one connector housing is only fitted while being unlocked. The one connector housing can be detached from the bracket by being pulled in a direction opposite from an inserting direction of the bracket into the insertion path.

As the two connector housings are separated by operating the lever, the bracket is also unlocked and the one connector housing can be easily detached from the bracket by being successively pulled. Further, since the locked state is also canceled taking advantage of the cam function by the lever, it can be done with a small operation force.

Since both follower pins can be united and the cam groove is a single groove common to both follower pins with only a necessary area thereof divided into the differently shaped cam surfaces, the construction of the connector is simpler, which leads to the miniaturization of the connector.

The cover is held at the positions proximate to and distanced from the one connector housing, if necessary. Thus, a locking function and an unlocking function can be more securely fulfilled.

Although the present invention has been shown and described with reference to specific embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector including a first connector and a second connector, wherein the first connector comprises:

a first connector housing;

a cover that forms a wire draw-out passage and mountable on a backside of the first connector housing so as to be movable in directions toward and away from the first connector housing;

an insertion path into which a bracket is inserted and protruded to a position where more backward than the cover;

a locking member provided on a facing surface of the cover and the bracket and engages to an locked portion formed on the bracket;

a first follower pin provided on the first connector housing; and a second follower pin provided on the cover, wherein the second connector comprises:

a second connector housing that is to be connected with the first connector housing; and a lever that is rotatably attached to the second connector housing and formed with a cam groove that is engageable with both the first and the second follower pins, wherein the cover is mounted on the first connector housing at a position distanced from a rear surface of the first connector housing when the first and the second connectors are in a non-connected state, wherein the first connector housing is connected with or separated from the second connector housing together with the cover by a cam action between the cam groove and both of the first and the second follower pins caused by a rotation of the lever, wherein an amount of a separation of the cover is configured to be less than an amount of a separation of the first connector housing with respect to the second connector housing at a final stage of a separating operation.

2. The connector according to claim 1, wherein the first and the second follower pins are configured to be integrally united, wherein the cam groove is formed in a single groove shape so as to be engaged with the first and the second follower pins in a state where the first and the second follower pins are integrally united, and wherein the cam groove is formed with a two differently shaped cam surfaces in an area of the cam groove corresponding to the final stage of the separating operation, so that each of the first and the second follower pins individually engages with the corresponding cam surfaces.

3. The connector according to claim 1, wherein the first connector further comprises a holding member that holds the cover at a position proximate to the first connector housing and at the position distanced from the first connector housing.

* * * * *

UNITED STATES PATENT AND TRADEMARK OFFICE

CERTIFICATE OF CORRECTION

PATENT NO. : 6,878,002 B2
DATED : April 12, 2005
INVENTOR(S) : Hiroki Osawa et al.

It is certified that error appears in the above-identified patent and that said Letters Patent is hereby corrected as shown below:

Title page,
Insert Item -- [30] Foreign Application Priority Data
Apr. 24, 2003 (JP) ……. 2003-120111 --.

Signed and Sealed this

Sixteenth Day of August, 2005

JON W. DUDAS
*Director of the United States Patent and Trademark Office*